US011286680B2

(12) United States Patent
Komatsu et al.

(10) Patent No.: US 11,286,680 B2
(45) Date of Patent: Mar. 29, 2022

(54) REINFORCEMENT DEVICE FOR EXISTING STRUCTURE AND INCIDENTAL FACILITY ATTACHING DEVICE

(71) Applicant: ITC CONSULTING INC., Tokyo (JP)

(72) Inventors: Hiroshi Komatsu, Narashino (JP); Keigo Ishii, Tokyo (JP)

(73) Assignee: ITC CONSULTING INC., Tokyo (JP)

( * ) Notice: Subject to any disclaimer, the term of this patent is extended or adjusted under 35 U.S.C. 154(b) by 0 days.

(21) Appl. No.: 16/961,335

(22) PCT Filed: Oct. 8, 2019

(86) PCT No.: PCT/JP2019/039570
§ 371 (c)(1),
(2) Date: Jul. 10, 2020

(87) PCT Pub. No.: WO2020/090370
PCT Pub. Date: May 7, 2020

(65) Prior Publication Data

US 2021/0310264 A1 Oct. 7, 2021

(30) Foreign Application Priority Data

Nov. 1, 2018 (JP) ..... JP2018-206306

(51) Int. Cl.
*E04G 23/02* (2006.01)
*E04H 12/10* (2006.01)

(52) U.S. Cl.
CPC ..... *E04G 23/0218* (2013.01); *E04H 12/10* (2013.01)

(58) Field of Classification Search
CPC ..... F16B 2200/506; F16B 5/0685; F16B 5/0607; F16B 5/0692; F16B 2200/509;
(Continued)

(56) References Cited

U.S. PATENT DOCUMENTS 1,403,051 A * 1/1922 Moore ..... E04H 12/10 52/638
2,073,889 A * 3/1937 Trout ..... E04G 23/0218 52/282.4

(Continued)

FOREIGN PATENT DOCUMENTS

JP 61-19786 3/1983
JP 2008-291620 A 12/2008

(Continued)

OTHER PUBLICATIONS

Machine translation of foreign reference JP2014-139384, obtained from https://www.j-platpat.inpit.go.jp/p0200 (last accessed on Sep. 7, 2021) (Year: 2021).*

(Continued)

*Primary Examiner* — Theodore V Adamos
(74) *Attorney, Agent, or Firm* — Pearne & Gordon LLP

(57) ABSTRACT

A reinforcing device for reinforcement of an angle material of an existing structure includes two band members for holding both sides of the angle material. A band auxiliary member is arranged at an inside corner of the angle material, a joining bolt/nut set is provided for joining the band auxiliary member and one end of each of the band members together, and a tightening bolt/nut set is provided for integrally fixing the other end of each of the band members to the angle material. The joining bolt/nut set and the tightening bolt/nut set are arranged only one by one respectively at one end and the other end of each of the band members. An outer face of each of the band members has reinforcing ribs provided at either an upper part or a lower part of each of the two band members.

6 Claims, 10 Drawing Sheets

(58) Field of Classification Search
CPC ..... E04G 23/0218; E04H 12/10; E04B 1/18; E04B 1/24; B66C 23/28
See application file for complete search history.

(56) References Cited

U.S. PATENT DOCUMENTS

| | | | | |
|---|---|---|---|---|
| 2,145,232 | A * | 1/1939 | Bauer | E04H 12/10 52/651.06 |
| 2,664,636 | A * | 1/1954 | Schneider | E04G 21/1808 33/406 |
| 3,499,258 | A * | 3/1970 | Pierre | B66C 23/286 52/637 |
| 2008/0295424 | A1* | 12/2008 | Crosbie | E04H 12/10 52/223.11 |
| 2009/0025312 | A1* | 1/2009 | Deans | E04C 3/02 52/167.3 |
| 2010/0132300 | A1* | 6/2010 | Kim | E04H 12/10 52/655.1 |
| 2011/0239585 | A1* | 10/2011 | Kim | E04H 12/10 52/835 |

FOREIGN PATENT DOCUMENTS

| | | | |
|---|---|---|---|
| JP | 2008-308937 | A | 12/2008 |
| JP | 2014-139384 | A | 7/2014 |
| JP | 2016-20592 | A | 2/2016 |
| JP | 2016-20593 | A | 2/2016 |
| JP | 6210453 | B2 | 10/2017 |
| JP | 6301212 | B2 | 3/2018 |
| JP | 2018-080482 | A | 5/2018 |
| JP | 6368569 | B2 | 8/2018 |
| JP | 6400064 | | 10/2018 |

OTHER PUBLICATIONS

Chinese Office Action issued in Chinese Patent Application No. 201980033181.9 dated May 18, 2021.
International Search Report for PCT/JP2019/39570, dated Dec. 17, 2019.

* cited by examiner

[FIG. 1]
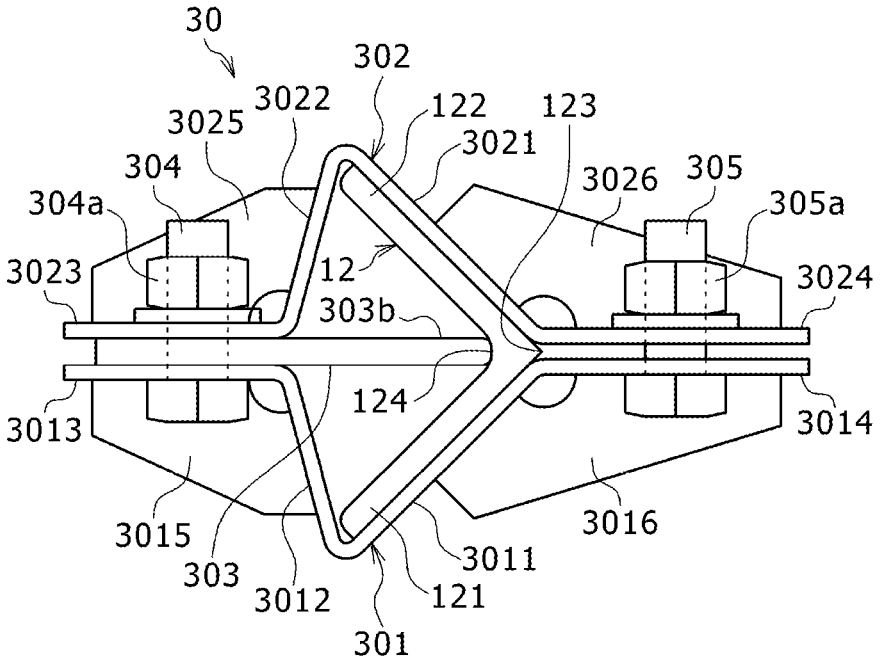
[FIG. 2]
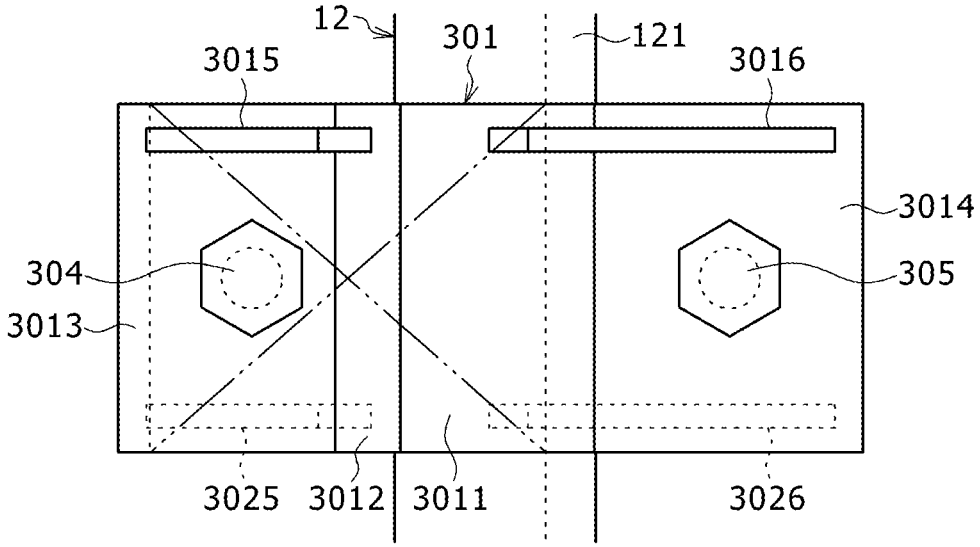

[FIG. 3]
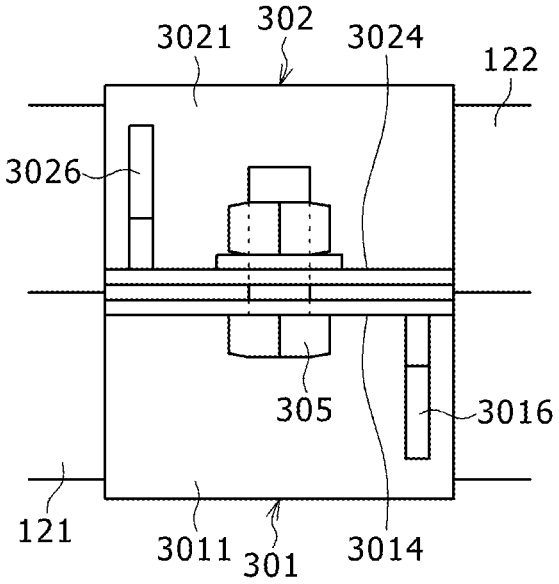
[FIG. 4]
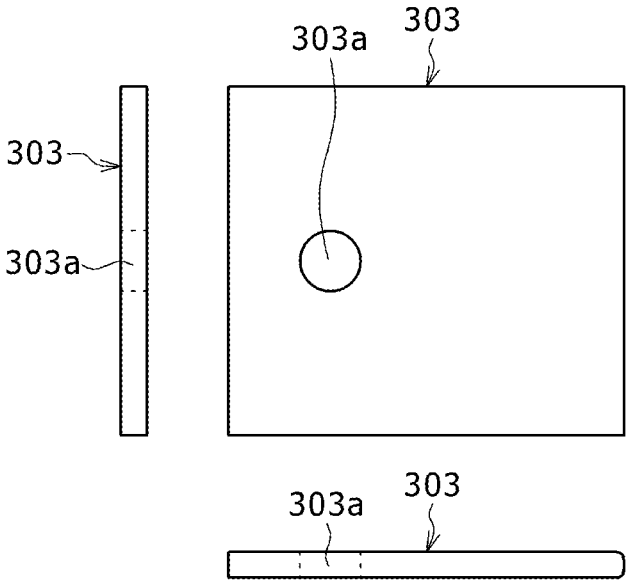

[FIG. 5]
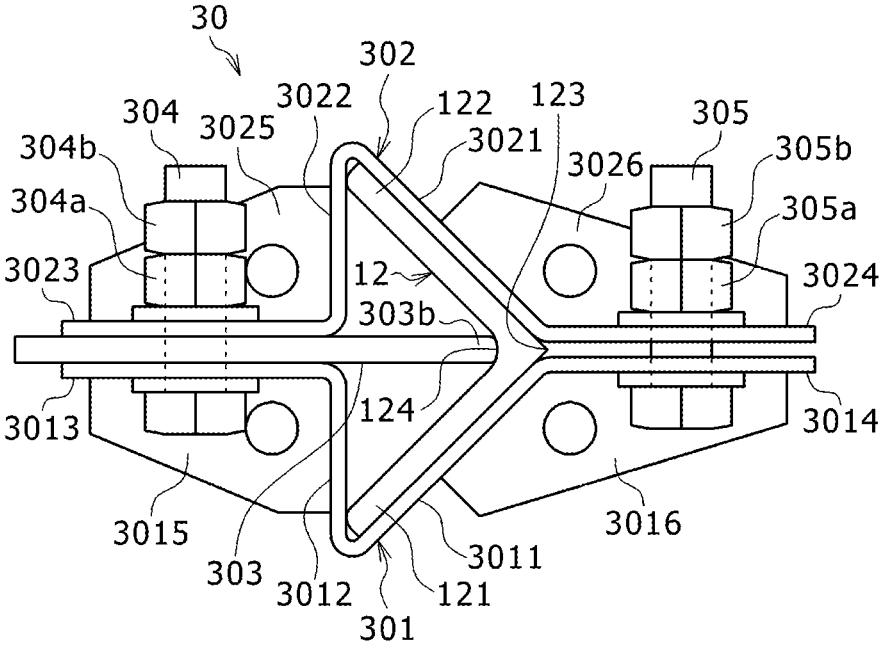
[FIG. 6]
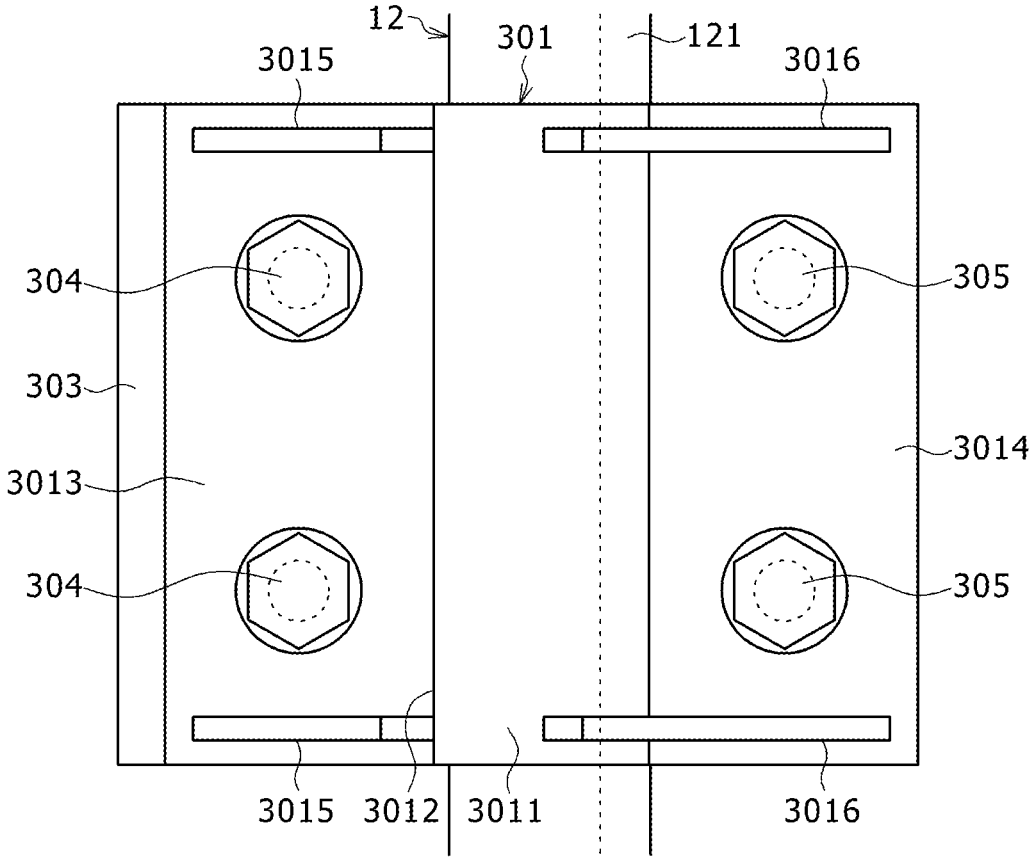

[FIG. 7]
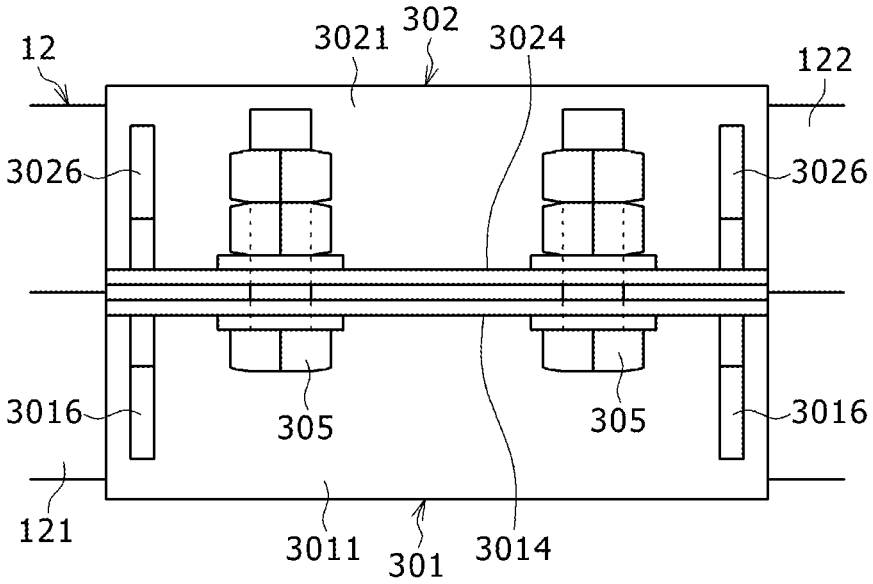
[FIG. 8]
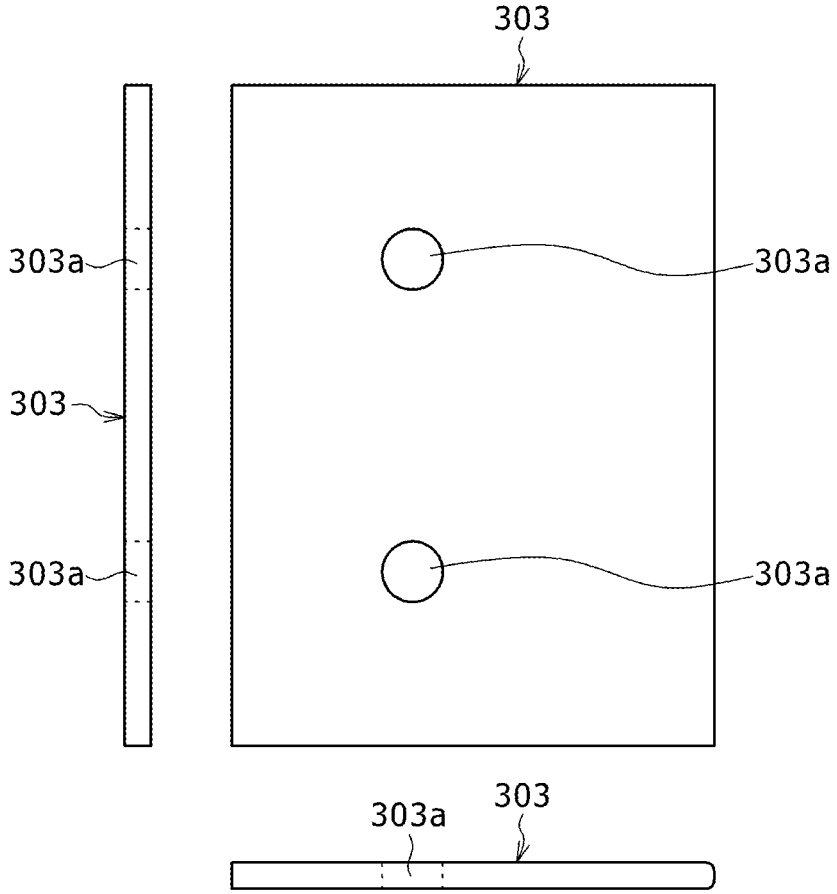

[FIG. 9]
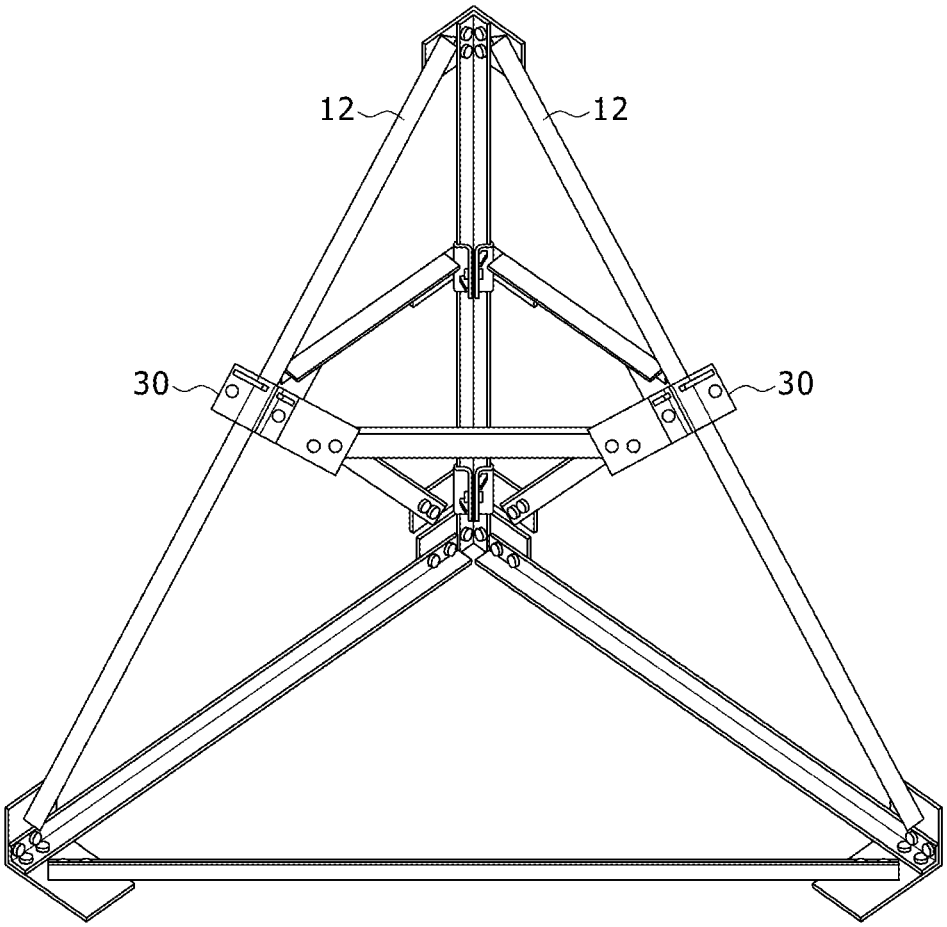

[FIG.10]
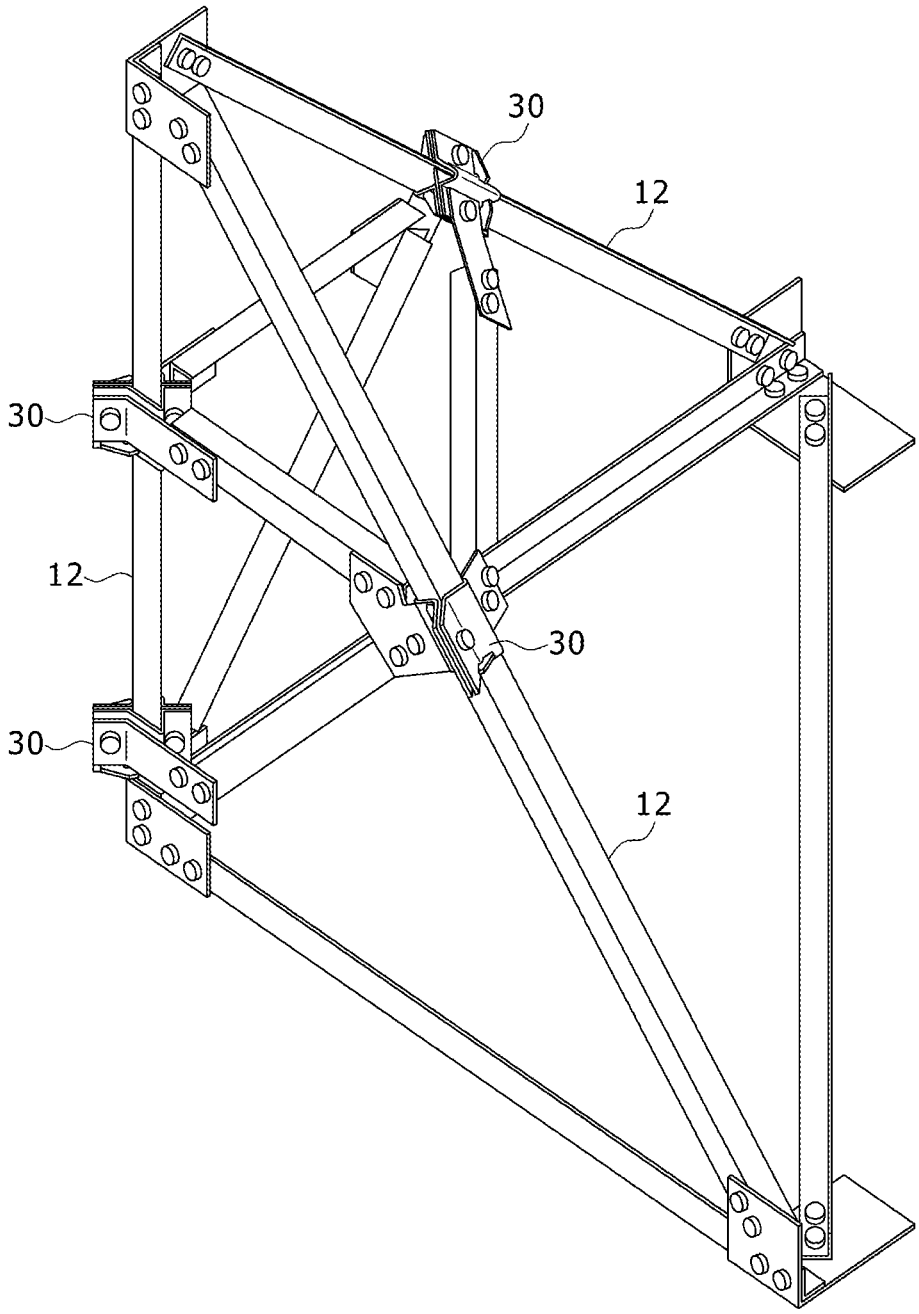

[FIG.11]
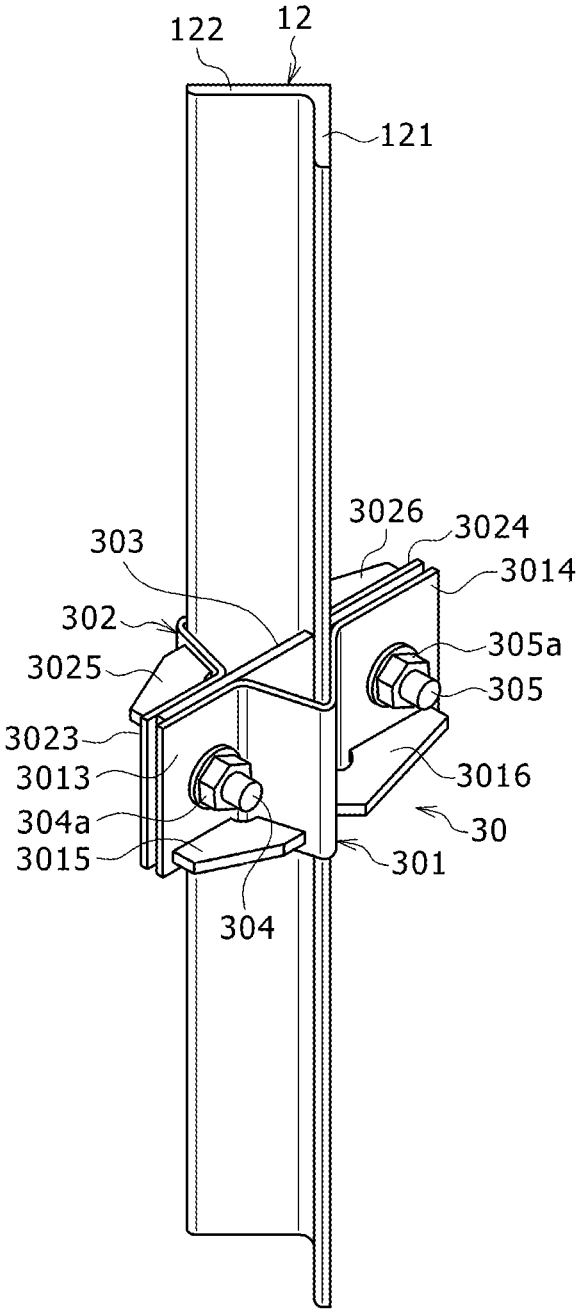

[FIG.12]
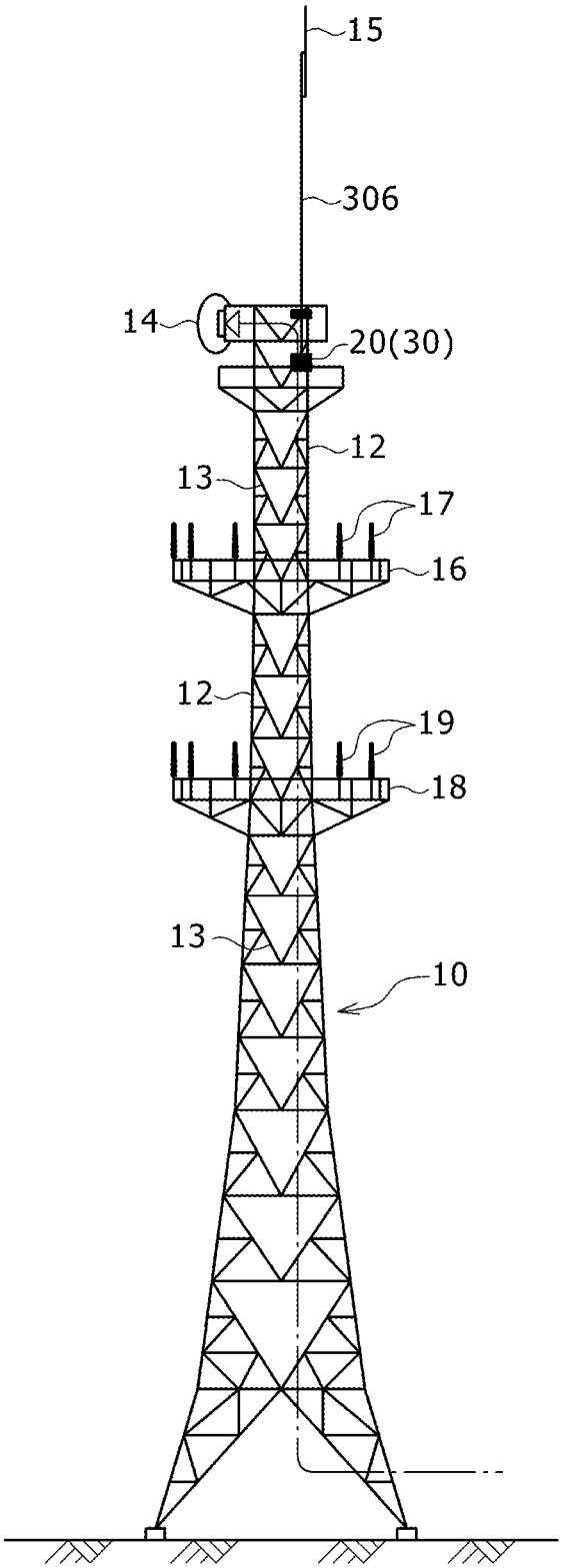

[FIG.13]
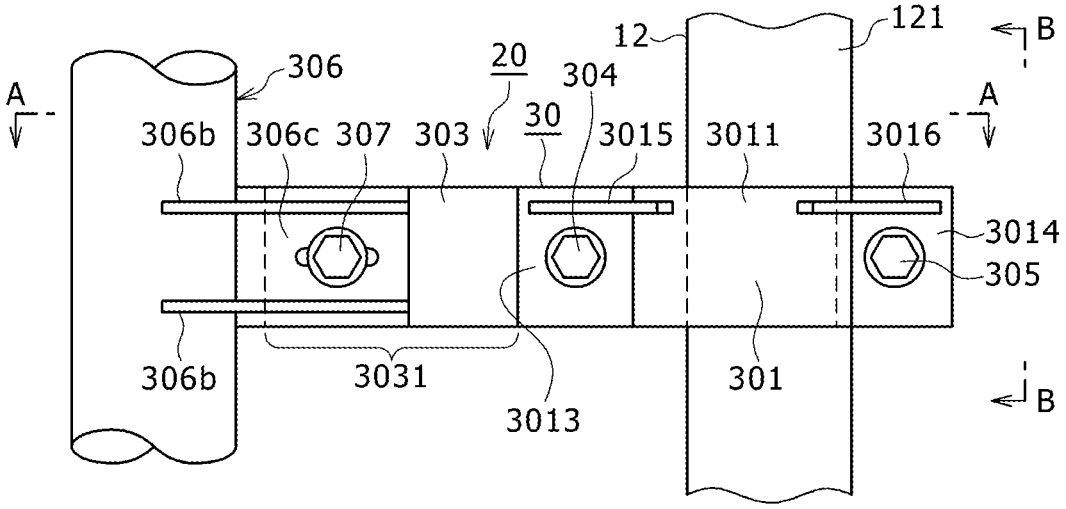
[FIG.14]
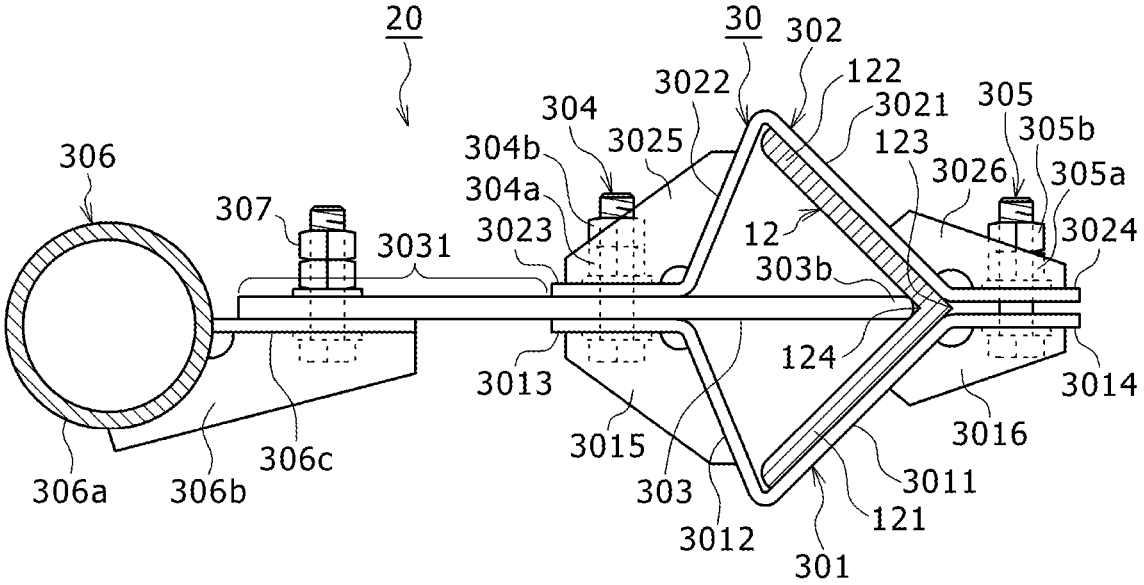

[FIG.15]
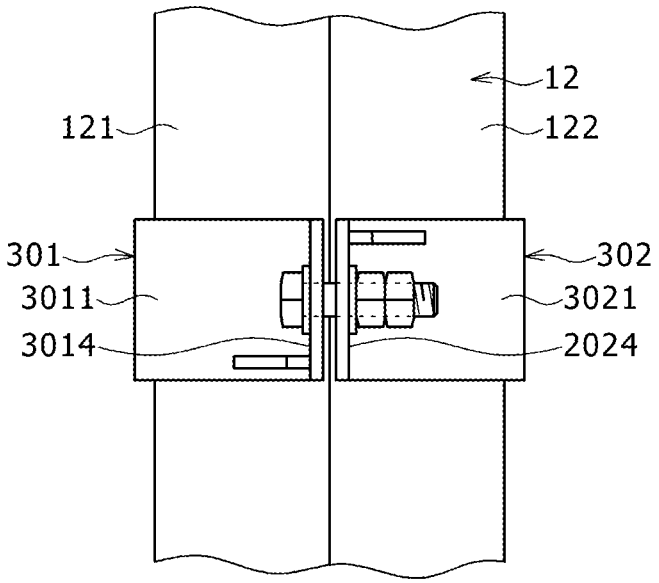
[FIG.16]
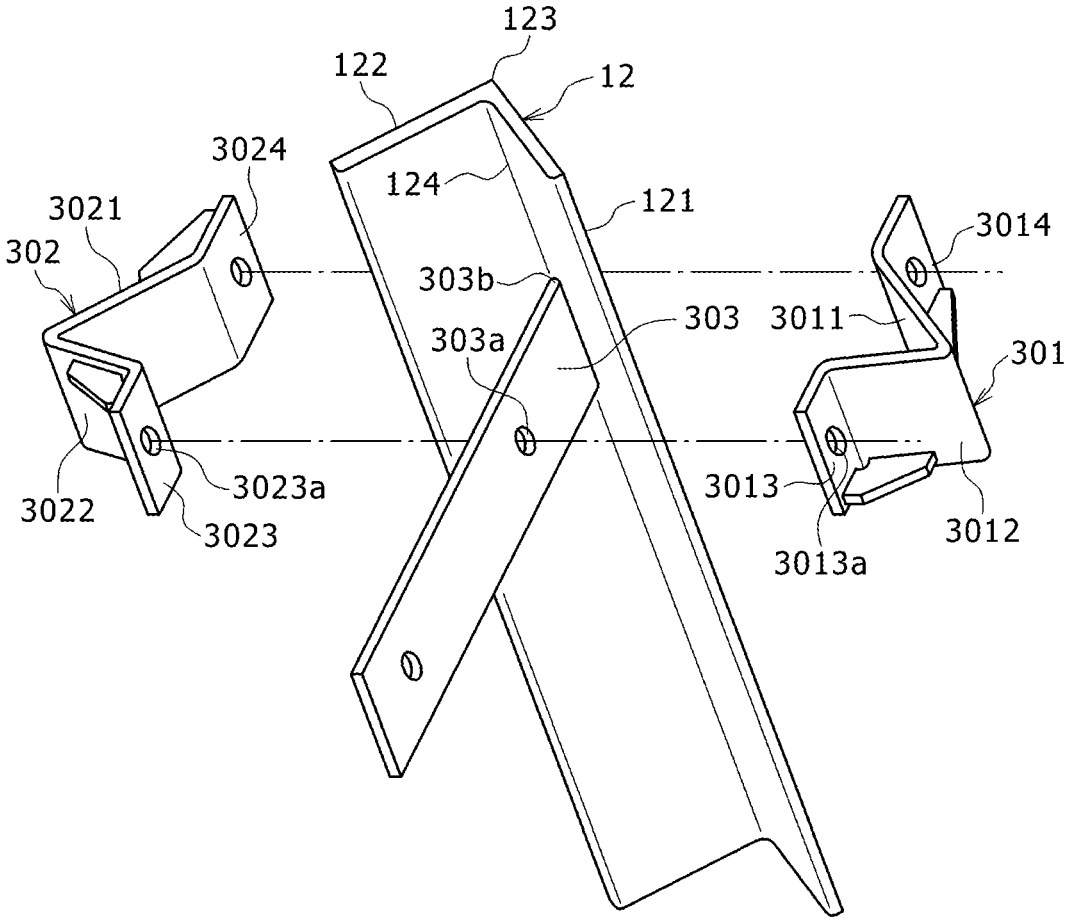

REINFORCEMENT DEVICE FOR EXISTING STRUCTURE AND INCIDENTAL FACILITY ATTACHING DEVICE

TECHNICAL FIELD

This invention relates to a reinforcing device of an existing structure that is capable of being attached to an angle material constituting the existing structure to thereby reinforce the existing structure, and an incidental equipment attaching device that allows also the incidental equipment such as an antenna and a lightning rod to be attached to the existing structure such as a steel tower.

BACKGROUND ARTS

A structure such as a steel tower and a building is constituted of angle materials and/or other shape steels and would therefore incur deformation, buckling and/or aged deterioration in the angle materials and/or other shape steels due to various factors such as earthquakes and weathers. Examples of reinforcing devices for reinforcement of an existing structure of this type include "a reinforcing device of an existing steel frame structure" by the present applicant as disclosed in Japanese Patent Publication No. 6301212 (refer to a patent document 1 below).

Meanwhile, an existing steel tower installed on the ground or the rooftop of a building or the like is getting utilized as an installation place of an antenna for mobile phone communications and/or emergency radio broadcastings or alternatively, as that of a lightning rod. Examples of the well-known arts for attachment of the incidental equipment such as the antenna to an existing angle steel material constituting a structure include "an incidental equipment attaching device" by the present applicant as disclosed in Japanese Unexamined Patent Application Publication No. 2018-080482 (refer to a patent document 2 below).

The patent document 1 describes a reinforcing device of an existing steel frame structure constituted by using a parallel-type angle steel assembly formed by combining a first angle steel material and a second angle steel material together to ensure that one side of the first angle steel material and that of the second angle steel material are arranged in close proximity to each other in parallel.

Specifically, the device described in the patent document 1 is a reinforcing device of an existing steel frame structure that is characterized by having a first reinforcing plate material having a width larger than each width of both sides of a first angle steel material and arranged extendedly over the entire length of a lengthwise direction of the first angle steel material to ensure that one end edge in a widthwise direction is placed in contact with an inside corner of the first angle steel material while being in a middle position of a place where an opening angle formed by both sides is bisected, a second reinforcing plate material having a width larger than each width of both sides of a second angle steel material and arranged extendedly over the entire length in a lengthwise direction of the second angle steel material to ensure that one end edge in a widthwise direction is placed in contact with an inside corner of the second angle steel material while being in a middle position of a place where an opening angle formed by both sides is bisected, and a plurality of fixing mechanisms for integrally fixing the first reinforcing plate material to the first angle steel material and also the second reinforcing plate material to the second angle steel material in a plurality of places in the lengthwise direction of the first and second angle steel materials, wherein the fixing mechanism has a support plate material arranged so as to extend in a direction orthogonal to the lengthwise direction of the first and second angle steel materials through a clearance formed between one side of the first angle steel material and that of the second angle steel material, first and second fixing metal fittings each having one end fixed with a first fixing bolt/nut set to a tip part of the first reinforcing plate material projecting outward from the first angle steel material, third and fourth fixing metal fittings each having one end fixed with a second fixing bolt/nut set to a tip part of the second reinforcing plate material projecting outward from the second angle steel material, fifth and sixth fixing metal fittings each having one end fixed with a third fixing bolt/nut set to a tip part of the support plate material projecting outward through a clearance formed between the other side of the first angle steel material and that of the second angle steel material, a first tightening bolt/nut set for bringing the first reinforcing plate material into pressure contact with the inside corner of the first angle steel material and also the second reinforcing plate material into pressure contact with the inside corner of the second angle steel material by arranging the other end of the first fixing metal fitting and that of the third fixing metal fitting opposite to each other on both sides of the tip part of the support plate material projecting outward through the clearance formed between one side of the first angle steel material and that of the second angle steel material and then tightening both the other ends in mutually approaching directions, a second tightening bolt/nut set for bringing the first reinforcing plate material into pressure contact with the inside corner of the first angle steel material by arranging the other end of the second fixing metal fitting and that of the fifth fixing metal fitting opposite to each other and then tightening both the other ends in mutually approaching directions, and a third tightening bolt/nut set for bringing the second reinforcing plate material into pressure contact with the inside corner of the second angle steel material by arranging the other end of the fourth fixing metal fitting and that of the sixth fixing metal fitting opposite to each other and then tightening both the other ends in mutually approaching directions.

The patent document 2 describes an incidental equipment attaching device for attaching the incidental equipment to an angle material having both sides with an L-shaped cross sectional shape to constitute a building, the incidental equipment attaching device being characterized by having a fixing tool for fixing the incidental equipment to the angle material, wherein the fixing tool has two band members arranged so as to hold both sides of the angle material from their respective outer face sides, a band auxiliary member arranged extendedly in a direction away from an inside corner of the angle material so as to bisect an angle formed by both sides of the angle material on the inside of the angle material, a joining bolt/nut set for joining an extended end of the band auxiliary member projecting from the angle material and one end of each band member together, a tightening bolt/nut set for integrally fixing the band auxiliary member to the angle material by the manner in which each band member is moved in a sliding contact state along an outer face of each side of the angle material toward an outside corner formed by both sides of the angle material to thereby press an end edge of the band auxiliary member against the inside corner of the angle material by tightening the other end of each band member in mutually approaching directions on the side of the outside corner of the angle material, and a support body provided at the extended end of the band auxiliary member to allow the incidental equipment to be attached thereto.

PRIOR ART DOCUMENTS

Patent Documents

Patent document 1: Japanese Patent Publication No. 6301212

Patent document 2: Japanese Unexamined Patent Application Publication No. 2018-080482

SUMMARY OF THE INVENTION

Problems to be Solved by the Invention

The reinforcing device described in the patent document 1 is constituted so as to fix the first to sixth fixing metal fittings by using the first to third fixing bolt/nut sets, together with the first to third tightening bolt/nut sets, for reinforcement of the first and second angle steel materials. Each of the first to third fixing bolt/nut sets and each of the first to third tightening bolt/nut sets are mounted by twos for one place, and hence, a high holding force and/or high stability would be secured when attachment of the reinforcing device to the angle steel materials is done, whereas the reinforcing device itself would cause an increase in weight, and the number of part items would be also increased.

Likewise, the incidental equipment attaching device described in the patent document 2 is constituted so as to focus on the holding force and/or stability to be secured when attachment of this device to the angle material is done, and hence, fixing is performed by using two joining bolt/nut sets and two tightening bolt/nut sets as shown in FIGS. 5 to 8, in which case, however, each band member would cause an increase in width, because of a need to secure also a spacing between two bolts, thus resulting in an increase in the weight of the device itself.

The present invention is made in order to overcome the defects in the above prior arts, and hence, an object of the present invention is to provide a reinforcing device of an existing structure that is capable of being easily attached to an angle material constituting the existing structure, and an incidental equipment attaching device that allows for attachment of also the incidental equipment such as an antenna and a lightning rod.

Means for Solving the Problems

The present invention provides a reinforcing device of an existing structure constituted by using an angle material having both sides with an L-shaped cross-sectional shape, the reinforcing device comprising two band members arranged so as to hold both sides of the angle material from their respective outer face sides, a band auxiliary member arranged extendedly in a direction away from an inside corner of the angle material so as to bisect an angle formed by both sides of the angle material on the inside of the angle material, a joining bolt/nut set for joining an extended end of the band auxiliary member projecting from the angle material and one end of each band member together, and a tightening bolt/nut set for integrally fixing the band auxiliary member to the angle material by the manner in which each band member is moved in a sliding contact state along an outer face of each side of the angle material toward an outside corner formed by both sides of the angle material to thereby press an end edge of the band auxiliary member against the inside corner of the angle material by tightening the other end of each band member in mutually approaching directions on the side of the outside corner of the angle material, wherein the joining bolt/nut set and the tightening bolt/nut set are arranged only one by one respectively at one end and the other end of each band member, instead of a configuration of arranging more than one joining bolt/nut set and more than one tightening bolt/nut set respectively thereat, and wherein an outer face of each band member has reinforcing ribs, the reinforcing ribs being provided at either an upper part or a lower part of each of the two band members, and the reinforcing ribs are arranged to ensure that the reinforcing ribs of the two band members are positioned on the sides mutually different in a vertical direction when attachment of the two band members in combination with each other to the angle material is done.

As described in the patent document 1, it has been believed that the pluralities of joining bolt/nut sets and tightening bolt/nut sets such as vertically arranged two or more joining bolt/nut sets and two or more tightening bolt/nut sets are required for fixing based on a common sense, with consideration of the holding force and/or stability to be secured in attachment of the reinforcing device to the angle material.

However, it is found that even one joining bolt/nut set and one tightening bolt/nut set are good enough for fixing, because of the fact that the angle material and the band members can be fixed together in a more closely contact state on the grounds of the constitution of the present invention in which the band auxiliary member is provided to thereby ensure that an end of the band auxiliary member is allowed to press the angle material from the inside over a certain amount of width. In this connection, the reinforcing device of the present invention is intentionally constituted such that the joining bolt/nut set and the tightening bolt/nut set are arranged only one by one respectively at one end and the other end of each band member, instead of the configuration of arranging more than one joining bolt/nut set and more than one tightening bolt/nut set respectively thereat.

Preferably, the outer face of each band member has the reinforcing ribs. The reinforcing ribs are provided at either the upper part or the lower part of each of the two band members, wherein it may be possible also that the reinforcing ribs are arranged to ensure that the reinforcing ribs of the two band members are positioned on the sides mutually different in the vertical direction when attachment of the two band members in combination with each other to the angle material is done.

The reinforcing ribs may be also provided at both the upper and lower parts of each band member, while it is found that a sufficient strength is exerted even when the reinforcing ribs are provided only at either the upper part or the lower part of each band member. When the reinforcing ribs only on one side of each band member are acceptable, the labor for fabricating the reinforcing device itself is saved, and the weight of the device itself is also reduced. A reduction in the spacing between the bolt and a rib plate results in allowing for suppression of deformation to be small. Alternate arrangement of the reinforcing ribs results in allowing pressure joining to the angle material to be kept balanced.

Each band member has a holding part having a length larger than a width of one side and brought into sliding contact with the outer face of the one side, a joining part joined to the extended end of the band auxiliary member with the joining bolt/nut set, a connecting part for connecting the holding part and the joining part together, and a tightening part provided at the end of the holding part on the side opposite to the connecting part, wherein the other end of each band member subjected to tightening in the mutually approaching directions with the tightening bolt/nut set forms the tightening part.

Each reinforcing rib is composed of a portion ranging over both the connecting part and the joining part and a portion ranging over both the holding part and the tightening part. The reinforcing ribs thus provided can enhance strength between the connecting part and the joining part of each band member and that between the tightening part and the holding part thereof.

In the two band members to be combined with each other, it may be possible also that these band members are subjected to bending to ensure that a longitudinal end of either one of the band members covers that of the other. This produces such effects as suppression of rotation of the device itself and convergence of movement in the longitudinal direction of the angle material.

Alternatively, it may be possible also that the joining bolt and the tightening bolt are welded to the band member in advance. Usually, works for fastening the bolt with the nut after insertion of the bolt through a bolt insertion hole take place at a working site, whereas in cases of a high-place working site, works for fastening the bolt with the nut at the same time as fixing of the bolt with a wrench are inefficient and, from the viewpoint of safety, involve a great danger such as accidental dropping and falling. Execution of welding of the bolts to the band member in advance results in allowing the nut side to be fastened and fixed with a single wrench, and hence, an attaching work is completed simply.

The present invention also provides an incidental equipment attaching device for attaching the incidental equipment to an angle material having both sides with an L-shaped cross-sectional shape to constitute a structure, the incidental equipment attaching device comprising a fixing tool for fixing the incidental equipment to the angle material, the fixing tool having two band members arranged so as to hold both sides of the angle material from their respective outer face sides, a band auxiliary member arranged extendedly in a direction away from an inside corner of the angle material so as to bisect an angle formed by both sides of the angle material on the inside of the angle material, a joining bolt/nut set for joining an extended end of the band auxiliary member projecting from the angle material and one end of each band member together, a tightening bolt/nut set for integrally fixing the band auxiliary member to the angle material by the manner in which each band member is moved in a sliding contact state along an outer face of each side of the angle material toward an outside corner formed by both sides of the angle material to thereby press an end edge of the band auxiliary member against the inside corner of the angle material by tightening the other end of each band member in mutually approaching directions on the side of the outside corner of the angle material, and a support body provided at the extended end of the band auxiliary member to allow the incidental equipment to be attached thereto, wherein the joining bolt/nut set and the tightening bolt/nut set are arranged only one by one respectively at one end and the other end of each band member, instead of a configuration of arranging more than one joining bolt/nut set and more than one tightening bolt/nut set respectively thereat, and wherein an outer face of each band member has reinforcing ribs, the reinforcing ribs being provided at either an upper part or a lower part of each of the two band members, and the reinforcing ribs are arranged to ensure that the reinforcing ribs of the two band members are positioned on the sides mutually different in a vertical direction when attachment of the two band members in combination with each other to the angle material is done.

Like the reinforcing device, it is found that even one joining bolt/nut set and one tightening bolt/nut set are good enough for fixing, because of the fact that the angle material and the band members can be fixed together in a more closely contact state on the grounds of each band member of the incidental equipment attaching device in which the band auxiliary member is provided to thereby ensure that the end of the band auxiliary member is allowed to press the angle material from the inside over a certain amount of width. In this connection, the incidental equipment attaching device of the present invention is intentionally constituted such that the joining bolt/nut set and the tightening bolt/nut set are arranged only one by one respectively at one end and the other end of each band member, instead of the configuration of arranging more than one joining bolt/nut set and more than one tightening bolt/nut set respectively thereat.

In the incidental equipment attaching device of the present invention, it may be possible also that the outer face of each band member has the reinforcing ribs. The reinforcing ribs are provided at either the upper part or the lower part of each of the two band members, and may preferably be arranged to ensure that the reinforcing ribs of the two band members are positioned on the sides mutually different in the vertical direction when attachment of the two band members in combination with each other to the angle material is done. The reinforcing ribs may be also provided at both the upper and lower parts of each band member, while a sufficient strength is exerted even when the reinforcing ribs are provided at either the upper part or the lower part of each band member so as to be vertically at alternate positions when attachment of the band members to the angle material is done.

Like the reinforcing device, each band member of the incidental equipment attaching device has a holding part having a length larger than a width of one side and brought into sliding contact with an outer face of the one side, a joining part joined to the extended end of the band auxiliary member with the joining bolt/nut set, a connecting part for connecting the holding part and the joining part together, and a tightening part provided at the end of the holding part on the side opposite to the connecting part, wherein the other end of each band member subjected to tightening in the mutually approaching directions with the tightening bolt/nut set forms the tightening part.

Each reinforcing rib is preferably composed of a portion ranging over both the connecting part and the joining part and a portion ranging over both the holding part and the tightening part and thus can enhance a strength between the joining part and the connecting part and that between the tightening part and the holding part, like the reinforcing ribs of the reinforcing device.

In the two band members to be combined with each other, it may be possible also that these band members are subjected to bending to ensure that a longitudinal end of either one of the band members covers that of the other. Execution of bending of the end of each band member results in allowing for suppression of rotation of the incidental equipment attaching device itself.

It may be possible also that the joining bolt and the tightening bolt of the incidental equipment attaching device are welded to the band member in advance.

Effects of the Invention

The reinforcing device of the existing structure and the incidental equipment attaching device according to the present invention are constituted as described the above and thus provide the effects as follows.

(1) Easy and firm attachment to the structure is achieved without applying any machining to the existing angle material itself constituting the structure and without looseness. In addition, an attachment holding force of the incidental equipment to the angle material can be secured semi-permanently.

(2) Execution of attachment of two band members by using one joining bolt/nut set and one tightening bolt/nut set results in allowing for lessening of an increasing load when designing. Further, the efficiency in the attaching work can be substantially improved thanks to both an easiness in fabrication and a reduction in the number of part items, as compared with the conventional device.

(3) There is no fear of causing any rotation of the band members themselves even when attached by using one joining bolt/nut set and one tightening bolt/nut set.

(4) A reduction in the width of each band member causes the spacing between the reinforcing rib and each of the joining bolt/nut set and the tightening bolt/nut set to be reduced, thereby resulting in allowing deformation to be suppressed to be small.

(5) Alternate arrangement of the reinforcing ribs results in allowing the pressure joining to a base material to be made uniform and thus kept balanced. Further, close-contact joining to the base material is enhanced for more stabled fixing to the base material by inducing somewhat deformation.

(6) Because of the arrangement of the reinforcing ribs only on one side, it is easy for a fastening tool to put in and perform fixing when fastening the joining nut and/or the tightening nut.

(7) Because of the reduction in the width of the band member and also the reduction in the number of reinforcing ribs and that of bolts as compared with the conventional device, the weight of the device itself can be reduced.

(8) Execution of bending of the opposite ends of each band member results in allowing for suppression of the rotation of the device itself and also convergence of the movement in the direction orthogonal to the angle material. An apparently closed section is formed by bringing the opposite ends of either one of the band members into contact with those of the other, and hence, this will lead to improvement of the stability and/or fixing degree and strength of the device itself.

(9) Execution of welding of the joining bolt and the tightening bolt to the band member in advance results in allowing the nut side to be fixed only by fastening with the single wrench in the course of an attaching work, and hence, the attaching work is simplified.

(10) It is economical because of the fact that a process of fabrication of the device itself can be shortened thanks to the reduction in the number of part items resulting from the reduction in the device size to about half of that of the conventional device.

BRIEF DESCRIPTION OF THE DRAWINGS

FIG. 1 is a plan view showing a first embodiment of a reinforcing device of an existing structure according to the present invention.

FIG. 2 is a front view of the reinforcing device in the first embodiment shown in FIG. 1.

FIG. 3 is a side view of the reinforcing device in the first embodiment shown in FIG. 1.

FIG. 4 is a view including a front view and a side view both showing a band auxiliary member in the first embodiment shown in FIG. 1.

FIG. 5 is a plan view showing one conventional embodiment of an incidental equipment attaching device of an existing structure.

FIG. 6 is a front view of the device in the conventional embodiment shown in FIG. 5.

FIG. 7 is a side view of the device in the conventional embodiment shown in FIG. 5.

FIG. 8 is a view including a front view and a side view both showing a band auxiliary member in the conventional embodiment shown in FIG. 5.

FIG. 9 is a partially schematic perspective view showing one embodiment (a second embodiment) when the reinforcing device according to the present invention is applied to a truss structure being an existing steel frame structure.

FIG. 10 is a partially schematic perspective view showing an embodiment different from the embodiment shown in FIG. 9

FIG. 11 is an enlarged perspective view showing a part of each of the embodiments shown in FIGS. 10 and 11 in an enlarged scale.

FIG. 12 is a schematic illustration showing one embodiment (a third embodiment) when a lightning rod is attached to an existing steel tower for antenna by using an incidental equipment attaching device according to the present invention.

FIG. 13 is a front view showing the incidental equipment attaching device when the lightning rod is attached to an angle material constituting the steel tower for antenna shown in FIG. 12.

FIG. 14 is a plan view showing the incidental equipment attaching device taken on arrows A-A in FIG. 13.

FIG. 15 is a plan view showing the incidental equipment attaching device taken on arrows B-B in FIG. 13.

FIG. 16 is an exploded perspective view showing a part of the incidental equipment attaching device shown in FIG. 13.

MODE FOR EMBODYING THE INVENTION

First Embodiment

Hereinafter, a first embodiment of a reinforcing device 30 of an existing structure according to the present invention will be described with reference to FIGS. 1 to 4.

The reinforcing device 30 is constituted by including a first band member 301 and a second band member 302 that are arranged bisymmetrically so as to hold both sides of an angle material 12 from their respective outside face sides, a band auxiliary member 303, one joining bolt/nut set 304 and one tightening bolt/nut set 305. In this first embodiment, the first band member 301 and the second band member 302 respectively correspond to two band members defined in the scope of claims.

The first band member 301 is formed of a steel plate material and arranged extendedly in a direction orthogonal to a widthwise direction of one side 121 of the angle material 12 so as to be placed in contact with an outer face of one side 121. The first band member 301 has a first holding part 3011 allowed to come in pressure contact with the outer face of one side 121 of the angle material 12 and having a length larger than a width of one side 121, a first connecting part 3012 provided at one end of the first holding part 3011 extendedly obliquely from one end of the first holding part toward one end of the band auxiliary member 303, a first joining part 3013 provided at a tip end of the first connecting part 3012 and joined to one end of the band auxiliary member 303, and a first tightening part 3014 provided at an end of the first holding part 3011 on the side opposite to the first connecting part 3012 to cause the first band member 301 to generate a tightening force.

Also, for the sake of enhancement of rigidity of the first band member 301, a reinforcing rib 3015 is provided in the state of being laid between the first connecting part 3012 and the first joining part 3013 in a place where the first connecting part 3012 and the first joining part 3013 are joined. Further, for the sake of enhancement of the rigidity of the first band member 301 as well, a reinforcing rib 3016 is provided in the state of being laid between the first holding part 3011 and the first tightening part 3014 in a place where the first holding part 3011 and the first tightening part 3014 are joined.

Like the first band member 301, the second band member 302 is also formed of a steel plate material and arranged extendedly in a direction orthogonal to a widthwise direction of the other side 122 of the angle material 12 so as to be placed in contact with an outer face of the other side 122. The second band member 302 has a second holding part 3021 allowed to come in pressure contact with the outer face of the other side 122 of the angle material 12 and having a length larger than a width of the other side 122, a second connecting part 3022 provided at one end of the second holding part 3021 extendedly obliquely from one end of the second holding part toward one end of the band auxiliary member 303, a second joining part 3023 provided at a tip end of the second connecting part 3022 and joined to one end of the band auxiliary member 303, and a second tightening part 3024 provided at an end of the second holding part 3021 on the side opposite to the second joining part 3023 to cause the second band member 302 to generate a tightening force.

Also, for the sake of enhancement of rigidity of the second band member 302, a reinforcing rib 3025 is provided in the state of being laid between the second connecting part 3022 and the second joining part 3023 in a place where the second connecting part 3022 and the second joining part 3023 are connected. Further, for the sake of enhancement of the rigidity of the second band member 302 as well, a reinforcing rib 3026 is provided in the state of being laid between the second holding part 3021 and the second tightening part 3024 in a place where the second holding part 3021 and the second tightening part 3024 are connected.

As shown in FIG. 2, the reinforcing ribs 3015, 3016 provided to the first band member 301 and the reinforcing ribs 3025, 3026 provided to the second band member 302 are arranged at either an upper part or a lower part of each of the first band member 301 and the second band member 302, wherein it is noted that the reinforcing ribs of the two band members are positioned on the mutually different sides when attachment of the two band members in combination with each other to the angle material 12 is done. Thus, alternate arrangement of the reinforcing ribs results in allowing pressure joining to the angle material 12 to be made uniform into a well-balanced condition. Further, a reduction of portions for providing the reinforcing ribs due to the alternate arrangement of the reinforcing ribs results in allowing for induction of somewhat deformation to ensure that close-contact joining to the angle material 12 is enhanced, and hence, stability to the angle material 12 is expectable.

The band auxiliary member 303 is a member for exhibiting an auxiliary function when fixed to the angle material 12 with the first and second band members 301, 302, and is formed of a strip-shaped steel plate material. As shown in FIG. 1, the band auxiliary member 303 is arranged extendedly in a direction away from an inside corner 124 of the angle material 12 so as to bisect an angle formed by both sides 121, 122 of the angle material 12 on the inside of the angle material 12.

The joining bolt/nut set 304 is a member for fixing both the first joining part 3013 of the first band member 301 and the second joining part 3023 of the second band member 302 to one end of the band auxiliary member 303 into an integral part in the state where one end of the band auxiliary member 303 is held between the first joining part 3013 and the second joining part 3023 on the inside of both sides 121, 122 of the angle material 12.

The tightening bolt/nut set 305 is a member for moving the first band member 301 in a sliding contact state along an outer face of one side 121 of the angle material 12 toward the side opposite to the inside of both sides 121, 122 of the angle material 12, that is, toward an outside corner 123 formed by both sides 121, 122 of the angle material 12 by tightening both the first tightening part 3014 of the first band member 301 and the second tightening part 3024 of the second band member 302 in mutually approaching directions on the side of the outside corner 123.

Simultaneously, the tightening bolt/nut set 305 is also for moving the second band member 302 in a sliding contact state along the outer face of the other side 122 of the angle material 12 toward the outside corner 123 of the angle material 12 to thereby press the other end **303*b* of the band auxiliary member 303 against the inside corner 124 of the angle material 12**.

Moreover, the tightening bolt/nut set 305 is also for fixing the first band member 301, the second band member 302 and the band auxiliary member 303 to the angle material 12 by bringing the first holding part 3011 of the first band member 301 into pressure contact with the outer face of one side 121 of the angle material 12 and also the second holding part 3021 of the second band member 302 into pressure contact with the outer face of the other side 122 of the angle material 12.

Alternatively, it may be possible also that the joining bolt 304 and the tightening bolt 305 are welded to the band member in advance. This results in allowing a nut side to be fixed only by fastening with a single wrench in the course of attachment of the reinforcing device 30 to the angle material 12, and hence, an attaching work is simplified.

A bending angle of each of the first band member 301 and the second band member 302 is set to be about 60 degrees in this embodiment, instead of about 45 degrees having been set heretofore. This is because there is a great difficulty in making the steel plate by being subjected to bending by an angle of 45 degrees, so that it is better to set the bending angle of about 60 degrees for easy bending and machining of the steel plate. Further, the first and second band members 301, 302 and the corresponding ends of the angle material 12 are allowed to gently contact each other, thereby providing higher pressure joining to the inside of the angle material 12. Moreover, a distance to the joining bolt 304 is decreased so that an amount of deflection of each of the band members 301, 302 and/or the band auxiliary member 303 is suppressed when band tightening, and hence, more reliable fixing is achieved.

Second Embodiment

Next, a second embodiment for reinforcement of the angle material 12 by using the reinforcing device 30 according to the present invention will be described with reference to FIGS. 9 to 11.

As shown in FIGS. 9 and 10, for instance, a steel frame structure (a truss structure) constituting a saw-tooth roof of a factory building is constituted of a horizontal material, inclined materials opposed to each other in the state of being inclined obliquely upward at a predetermined angle with respect to the horizontal material, vertical materials for joining between the horizontal material and the inclined material, and bracing materials arranged diagonally between the vertical material-separated horizontal material and inclined material to join the horizontal material and the inclined material together, each of these materials being the angle material 12 formed of an equilateral angle steel with an L-shaped cross-sectional shape. Further, both ends of each vertical material and those of each bracing material are respectively joined to the horizontal material and the inclined material through gusset plates provided at both the horizontal material and the inclined material. The steel material constituting the steel frame structure of the saw-tooth roof is allowed to use other shape steels such as flat steel, CT steel and channel steel in combination, in addition to the equilateral angle steel with the L-shaped cross-sectional shape.

The reinforcing device 30 for reinforcing the angle material 12 as shown in FIG. 11 takes the configuration as shown in FIGS. 1 to 4, and is thus constituted of the first band member 301 and the second band member 302 that are combined with each other so as to hold the angle material 12 in between, the band auxiliary member 303 arranged so as to bisect the inside corner 124 of the angle material 12, the joining bolt/nut set 304 for joining the first joining part 3013 and the second joining part 3023 together, and the tightening bolt/nut set 305 for tightening the first tightening part 3014 and the second tightening part 3024.

The reinforcing ribs are provided at the lower part of the first band member 301 and at the upper part of the second band member 302. The reinforcing ribs 3015, 3016 provided to the first band member 301 and the reinforcing ribs 3025, 3026 provided to the second band member 302 are arranged alternately so as to be positioned on the sides mutually different in the vertical direction, so that pressure joining to the angle material 12 is well-balanced.

In this second embodiment, easy and reliable reinforcement of the existing angle material 12 is allowed, together with use of the flat steel on the market for the band auxiliary member 303 of the reinforcing device 30 of the existing steel frame structure shown in this embodiment. In addition to the above, handling and/or management of the fixing part items in the course of execution of reinforcement construction can be facilitated and simplified, and the shortening of a reinforcement construction period and the reduction of reinforcement construction costs are also made possible.

Third Embodiment

Next, a third embodiment for attachment of a lightning rod 15 by using an incidental equipment attaching device according to the present invention will be described with reference to FIGS. 12 to 16.

Referring to FIG. 12, an existing steel tower 10 for antenna (which corresponds to a structure defined in the scope of claims) has four angle materials 12 each formed of an equilateral angle steel material with two equal sides of an L-shape and constituting a support of the steel tower, and a truss structural material 13 laid between these angle materials 12.

A parabolic antenna 14 for communications is installed at the top of the steel tower 10 for antenna, and the lightning rod 15 (which corresponds to the incidental equipment defined in the scope of claims) is also installed extendedly above the steel tower 10 for antenna. Further, a plurality of receiving antennas 17 are installed around a platform 16 provided to the steel tower 10 for antenna in a position below the parabolic antenna 14. A plurality of transmitting antennas 19 are also installed around a platform 18 provided to the steel tower 10 for antenna in a position below the platform 16.

An incidental equipment attaching device 30 is a device for attaching the lightning rod 15 to the angle material 12 of the steel tower 10 for antenna and has a fixing tool 20 for fixing the lightning rod 15 to the angle material 12, as shown in FIGS. 12 to 14.

The fixing tool 20 is constituted by including a first band member 301 and a second band member 302 that are arranged bisymmetrically so as to hold both sides of the angle material 12 from their respective outer face sides, a band auxiliary member 303, one joining bolt/nut set 304, one tightening bolt/nut set 305 and a support body 306. In this third embodiment, the first band member 301 and the second band member 302 respectively correspond to two band members defined in the scope of claims.

The first band member 301 is a member for fixing the lightning rod 15 to the angle material 12, the first band member being formed of a steel plate material and arranged extendedly in a direction orthogonal to a widthwise direction of one side 121 of the angle material 12 so as to be placed in contact with an outer face of one side 121.

As shown in FIG. 14, the first band member 301 has a first holding part 3011 allowed to come in pressure contact with the outer face of one side 121 of the angle material 12 and having a length larger than a width of one side 121, a first connecting part 3012 provided at one end of the first holding part 3011 extendedly obliquely from one end of the first holding part toward one end of the band auxiliary member 303, a first joining part 3013 provided at a tip end of the first connecting part 3012 and joined to one end of the band auxiliary member 303, and a first tightening part 3014 provided at an end of the first holding part 3011 on the side opposite to the first connecting part 3012 to cause the first band member 301 to generate a tightening force.

Also, for the sake of enhancement of rigidity of the first band member 301, a reinforcing rib 3015 is provided in the state of being laid between the first connecting part 3012 and the first joining part 3013 in a place where the first connecting part 3012 and the first joining part 3013 are joined. Further, for the sake of enhancement of the rigidity of the first band member 301 as well, a reinforcing rib 3016 is provided in the state of being laid between the first holding part 3011 and the first tightening part 3014 in a place where the first holding part 3011 and the first tightening part 3014 are joined.

The second band member 302 is a member for fixing the lightning rod 15 to the angle material 12, the second band member being formed of a steel plate material and arranged extendedly in a direction orthogonal to a widthwise direction of the other side 122 of the angle material 12 so as to be placed in contact with an outer face of the other side 122.

The second band member 302 has a second holding part 3021 allowed to come in pressure contact with the outer face of the other side 122 of the angle material 12 and having a length larger than a width of the other side 122, a second connecting part 3022 provided at one end of the second holding part 3021 extendedly obliquely from one end of the second holding part toward one end of the band auxiliary member 303, a second joining part 3023 provided at a tip end of the second connecting part 3022 and joined to one end of the band auxiliary member 303, and a second tightening part 3024 provided at an end of the second holding part 3021 on the side opposite to the second joining part 3023 to cause the second band member 302 to generate a tightening force.

Also, for the sake of enhancement of rigidity of the second band member 302, a reinforcing rib 3025 is provided in the state of being laid between the second connecting part 3022 and the second joining part 3023 in a place where the second connecting part 3022 and the second joining part 3023 are connected. Further, for the sake of enhancement of the rigidity of the second band member 302 as well, a reinforcing rib 3026 is provided in the state of being laid between the second holding part 3021 and the second tightening part 3024 in a place where the second holding part 3021 and the second tightening part 3024 are connected.

The band auxiliary member 303 is a member for exhibiting an auxiliary function when fixing the support body 306 to the angle material 12 with the first and second band members 301, 302 and also for supporting the support body 306, and is formed of a strip-shaped steel plate material.

As shown in FIG. 14, the band auxiliary member 303 is arranged extendedly in a direction away from an inside corner 124 of the angle material 12 so as to bisect an angle formed by both sides 121, 122 of the angle material 12 on the inside of the angle material 12.

Also, the band auxiliary member 303 has a connecting part 3031 integrally provided by extending one end of the band auxiliary member 303 on the side opposite to the inside corner 124 of the angle material 12 in a longitudinal direction of the band auxiliary member 303, wherein the support body 306 for supporting the lightning rod 15 being the incidental equipment is attached to the connecting part 3031.

The support body 306 is a member for attaching the lightning rod 15 to the fixing tool 30, and as shown in FIGS. 13 and 14, has a cylindrical support 306*a* of a predetermined length and an attaching part 306*c* with a reinforcing rib 306*b* fixed by welding to the outer periphery of a lower end of the support 306*a*, wherein the attaching part 306*c* is attached to the connecting part 3031 with one bolt/nut set 307 formed of a high tension bolt/nut set, thereby integrally fixing the lightning rod 15 to the angle material 12.

The joining bolt/nut set 304 is a member for fixing both the first joining part 3013 of the first bond member 301 and the second joining part 3023 of the second bond member 302 to one end of the band auxiliary member 303 into an integral part in the state where one end of the band auxiliary member 303 is held between the first joining part 3013 and the second joining part 3023 on the inside of both sides 121, 122 of the angle material 12, the joining bolt/nut set being formed of a high tension bolt/nut set and having a joining nut 304*a* and a locking nut 304*b* for preventing the joining nut 304*a* from being loosened.

The tightening bolt/nut set 305 is a member for moving the first band member 301 in a sliding contact state along an outer face of one side 121 of the angle material 12 toward the side opposite to the inside of both sides 121, 122 of the angle material 12, that is, toward an outside corner 123 formed by both sides 121, 122 of the angle material 12 by tightening the first tightening part 3014 of the first band member 301 and the second tightening part 3024 of the second band member 302 in mutually approaching directions on the side of the outside corner 123 of the angle material 12.

Simultaneously, the tightening bolt/nut set 305 is also for moving the second band member 302 in a sliding contact state along the outer face of the other side 122 of the angle material 12 toward the outside corner 123 of the angle material 12 to thereby press the other end 303*b* of the band auxiliary member 303 against the inside corner 124 of the angle material 12.

Moreover, the tightening bolt/nut set 305 is also for fixing the first band member 301, the second band member 302 and the band auxiliary member 303 to the angle material 12 by bringing the first holding part 3011 of the first band member 301 into pressure contact with the outer face of one side 121 of the angle material 12 and also the second holding part 3021 of the second band member 302 into pressure contact with the outer face of the other side 122 of the angle material 12.

This tightening bolt/nut set 305 is formed of a high tension bolt/nut set and has a tightening nut 305*a* and a locking nut 305*b* for preventing the tightening nut 305*a* from being loosened.

Next, one instance of a process in cases where the lightning rod 15 is fixed to the angle material 12 by using the incidental equipment attaching device 30 having the above constitution will be described.

Firstly, as shown in FIG. 16, the first joining part 3013 of the first band member 301 and the second joining part 3023 of the second band member 302 are plane-symmetrically overlapped with both sides of the band auxiliary member 303, and simultaneously, a bolt insertion hole 3013*a* of the first joining part 3013 and a bolt insertion hole 3023*a* of the second joining part 3023 are made to align with a bolt insertion hole 303*a* of the band auxiliary member 303.

Then, the bolt of the joining bolt/nut set 304 is inserted through these three bolt insertion holes that are in the state of being aligned with one another, and subsequently, the joining nut 304*a* is screwed to a tip part of the inserted bolt to thereby temporarily join the first band member 301 and the second band member 302 to the band auxiliary member 303. In this temporarily joined state, the first and second band members are openable in the direction away from the band auxiliary member 303 with the bolt of the joining bolt/nut set 304 as a fulcrum.

In this case, a spacing between the first tightening part 3014 including the first holding part 3011 of the first band member 301 and the second tightening part 3024 including the second holding part 3021 of the second band member 302 is preferably set to be larger than a spacing between both sides 121, 122 of the angle material 12 for the sake of integrating the first band member 301 and the second band member 302 with the angle material 12.

Next, the other end 303*b* of the band auxiliary member 303 is pressed against the inside corner 124 of the angle material 12 in the state where the first band member 301 and the second band member 302 are left open as described the above, with the bolt of the joining bolt/nut set 304 as the fulcrum.

Then, the first band member 301 and the second band member 302 that are in the open state are turned in the direction in which the angle material 12 is held from its opposite side faces, with the bolt of the joining bolt/nut set 304 as the fulcrum, to thereby bring the first holding part 3011 of the first band member 301 into contact with the outer face of one side 121 of the angle material 12 and also the second holding part 3021 of the second band member 302 into contact with the outer face of the other side 122 of the angle material 12.

In this state, the joining nut 304*a* is fastened to thereby fix the first band member 301 and the second band member 302 to the band auxiliary member 303 and also press the first holding part 3011 against the outer face of one side 121 of the angle material 12 and also the second holding part 3021 against the outer face of the other side 122 of the angle material 12.

Thereafter, the locking nut 304*b* is screwed and fastened to the bolt of the joining bolt/nut set 304 to thereby surely fix the first band member 301 and the second band member 302 to the band auxiliary member 303.

Next, the bolt of the tightening bolt/nut set 305 is inserted through both a bolt insertion hole 3014*a* formed in the first tightening part 3014 of the first band member 301 and a bolt insertion hole 3024*a* formed in the second tightening part 3024 of the second band member 302, and subsequently, the tightening nut 305*a* is screwed to a tip part of the inserted bolt to tighten the first tightening part 3014 and the second tightening part 3024 in the mutually approaching directions, thereby slidingly moving the first band member 301 in a pressure contact state along the outer face of one side 121 of the angle material 12 toward the outside corner 123 of the angle material 12 and simultaneously, also the second band member 302 in a pressure contact state along the outer face of the other side 122 of the angle material 12 toward the outside corner 123 of the angle material 12.

This allows the other end 303*b* of the band auxiliary member 303 to be strongly pressed against the inside corner 124 of the angle material 12, and also allows the first holding part 3011 of the first band member 301 and the second holding part 3021 of the second band member 302 to be respectively brought into pressure contact with the outer face of one side 121 of the angle material 12 and that of the other side 122 thereof.

Thus, the first band member 301, the second band member 302 and the band auxiliary member 303 are fixed to the angle material 12 into an integrated part. Thereafter, the locking nut 305*b* is screwed and fastened to the bolt of the tightening bolt/nut set 305 to thereby surely fix the fixing tool 20 to the angle material 12.

Specifically, it is desired that the incidental equipment attaching device should have a partial contact structure in which a first holding part 3011-portion closer to the first tightening part 3014 of the first band member 301 is allowed to partially come in pressure contact with the outer face of one side 121 of the angle material 12, and a second holding part 3021-portion closer to the second tightening part 3024 of the second band member 302 is also allowed to partially come in pressure contact with the outer face of the other side 122 of the angle material 12, whereas each outer face of both sides 121, 122 of the angle material 12 is not allowed to thoroughly come in contact with the first holding part 3011 of the first band member 301 and the second holding part 3021 of the second band member 302 respectively opposed thereto so as to ensure that no contact occurs in portions other than these first and second holding part portions, as shown in FIG. 14, and also that the tightening force should be concentrated to the corner formed by both sides of the angle material 12.

According to this structure, frictional resistance of the first and second holding parts 3011, 3021 with respect to both sides 121, 122 of the angle material 12 is reduced, and hence, an operation for tightening the first and second band members 301, 302 with the tightening bolt/nut set 305 is facilitated, thus resulting in allowing the fixing tool 20 to be surely fixed to the angle material 12.

For attachment of the support body 306 of the lightning rod 15 to the fixing tool 20 fixed to the angle material 12 as described the above, the support body 306 is attached by the manner in which the attaching part 306*c* provided to the support 306*a* is fixed to the connecting part 3031 of the band auxiliary member 303 with one bolt/nut set 307.

In this case, the number of fixing tools 20 for fixing the support 306*a* of the support body 306 to the angle material 12 is not necessarily one, and there may be also cases where more than one fixing tool should be used in accordance with the function, size and installation place or the like of the lightning rod 15.

It is a matter of course that a procedure for attaching the incidental equipment attaching device 30 to the angle material 12 need not to be limited to the above manner and hence, should be changed in accordance with the installation environments of the steel tower to which the incidental equipment attaching device 30 is attached and/or the places for attaching the incidental equipment attaching device to the steel tower.

According to the incidental equipment attaching device 30 that presents the above embodiment, it is constituted so as to fix the band auxiliary member 303, the first band member 301 and the second band member 302 to the angle material 12 into the integral part by the manner in which the first band member 301 is moved slidingly in the pressure contact state along the outer face of one side 121 of the angle material 12 toward the outside corner 123 of the angle material 12 and simultaneously, the second band member 302 is moved slidingly in the pressure contact state along the outer face of the other side 122 of the angle material 12 toward the outside corner 123 of the angle material 12 to thereby further press the band auxiliary member 303 strongly against the inside corner 124 of the angle material 12 and also bring the first holding part 3011 of the first band member 301 and the second holding part 3021 of the second band member 302 respectively into contact with the outer face of one side 121 of the angle material 12 and that of the other side 122 thereof by integrally joining the first band member 301 and the second band member 302 to the band auxiliary member 303 with the joining bolt/nut set 304 and then, in this joined state, tightening the first tightening part 3014 of the first band member 301 and the second tightening part 3024 of the second band member 302 in the mutually approaching directions.

Accordingly, for attachment of the lightning rod 15 to the angle material 12 of the exiting steel tower, the lightning rod 15 can be easily attached at the working site without applying any machining to the angle material 12 itself, and an attachment holding force of the lightning rod 15 with respect to the angle material 12 can be also secured semi-permanently.

Further, the fixing tool 20 can be fixed to the angle material 12 only by tightening the first tightening part 3014 of the first band member 301 and the second tightening part 3024 of the second band member 302 in the mutually approaching directions with the tightening bolt/nut set 305, so that more efficient construction for attachment of the lightning rod 15 to the steel tower is realizable together with the reduction in construction costs.

Moreover, the first band member 301 and the second band member 302 are reinforced with the reinforcing ribs 3015, 3016, 3025, 3026, so that the rigidity of the first band member 301 and that of the second band member 302 can be enhanced, thus resulting in allowing the fixing tool 20 and the angle material 12 to be integrated more firmly.

It is to be understood that the incidental equipment attaching device 30 according to the present invention is not limited to use for attachment of the antenna and/or the lightning rod to the steel tower as shown in the above embodiment, but may be of course applied also to attachment of other incidental equipment including the antenna and/or lightning rod to the structure constituted by using the angle material formed of the angle steel material or a pair of angle steel materials constituting a parallel-type angle steel assembly, and that various changes and modifications may be of course made without departing from the spirit and scope of the invention as hereinafter claimed.

EXPLANATION OF REFERENCE NUMERALS

10 . . . Steel tower for antenna, 12 . . . Angle material, 121 . . . Side of angle material, 122 . . . Side of angle material, 123 . . . Outside corner, 124 . . . Inside corner, 13 . . . Truss structure, 14 . . . Parabolic antenna, 15 . . . Lightning rod, 16 . . . Platform, 17 . . . Receiving antenna, 18 . . . Platform 19 . . . Transmitting antenna, 20 . . . Fixing tool 30 . . . Reinforcing device or incidental equipment attaching device, 301 . . . First band member, 3011 . . . First holding part, 3012 . . . First connecting part, 3013 . . . First joining part, 3014 . . . First tightening part, 3015 . . . Reinforcing rib, 3016 . . . Reinforcing rib, 302 . . . Second band member, 3021 . . . Second holding part, 3022 . . . Second connecting part, 3023 . . . Second joining part, 3024 . . . Second tightening part, 3025 . . . Reinforcing rib, 3026 . . . Reinforcing rib, 3027 . . . Bent part, 3028 . . . Bent part, 303 . . . Band auxiliary member, 303*a* . . . Bolt insertion hole of band auxiliary member, 303*b* . . . Other end of band auxiliary member, 3031 . . . Connecting part, 304 . . . Joining bolt/nut set, 304*a* . . . Joining nut, 304*b* . . . Locking nut, 305 . . . Tightening bolt/nut set, 305*a* . . . Tightening nut, 305*b* . . . Locking nut, 306 . . . Support body, 306*a* . . . Support, 306*b* . . . Reinforcing rib, 306*c* . . . Attaching part

The invention claimed is:

1. A reinforcing device of an existing structure constituted by using an angle material having both sides with an L-shaped cross-sectional shape, said reinforcing device comprising:

two band members arranged so as to hold both sides of said angle material at respective outer face sides of said angle material;

a band auxiliary member arranged extendedly in a direction away from an inside corner of said angle material so as to bisect an angle formed by both sides of said angle material on the inside of said angle material;

a joining bolt/nut set for joining an extended end of said band auxiliary member projecting from said angle material and one end of each of said band members together; and a tightening bolt/nut set for integrally fixing said band auxiliary member to said angle material by the manner in which each of said band members is moved in a sliding contact state along an outer face of each side of said angle material toward an outside corner formed by both sides of said angle material to thereby press an end edge of said band auxiliary member against the inside corner of said angle material by tightening the other end of each of said band members in mutually approaching directions on the side of said outside corner;

wherein said joining bolt/nut set and said tightening bolt/nut set are arranged only one by one respectively at one end and the other end of each of said band members, instead of a configuration of arranging more than one joining bolt/nut set and more than one tightening bolt/nut set respectively thereat, and wherein an outer face of each of said band members has reinforcing ribs, said reinforcing ribs being provided either only at an upper part or only at a lower part of each of said two band members, and said reinforcing ribs are arranged to ensure that said reinforcing ribs of said two band members are positioned on the sides mutually different in a vertical direction when attachment of said two band members in combination with each other to said angle material is done.

2. The reinforcing device of the existing structure according to claim 1, wherein each of said band members has a holding part having a length larger than a width of said one side and brought into sliding contact with the outer face of said one side, a joining part joined to an extended end of said band auxiliary member with said joining bolt/nut set, a connecting part for connecting said holding part and said joining part together, and a tightening part provided at an end of said holding part on the side opposite to said connecting part, wherein the other end of each of said band members subjected to tightening in the mutually approaching directions with said tightening bolt/nut set forms said tightening part.

3. The reinforcing device of the existing structure according to claim 1, wherein in said two band members to be combined with each other, these band members are subjected to bending to ensure that a longitudinal end of either one of the band members covers that of the other.

4. An incidental equipment attaching device for attaching the incidental equipment to an angle material having both sides with an L-shaped cross-sectional shape to constitute a structure, comprising:

a fixing tool for fixing said incidental equipment to said angle material;

said fixing tool having:

two band members arranged so as to hold both sides of said angle material at respective outer face sides of said angle material;

a band auxiliary member arranged extendedly in a direction away from an inside corner of said angle material so as to bisect an angle formed by both sides of said angle material on the inside of said angle material;

a joining bolt/nut set for joining an extended end of said band auxiliary member projecting from said angle material and one end of each of said band members together;

a tightening bolt/nut set for integrally fixing said band auxiliary member to said angle material by the manner in which each of said band members is moved in a sliding contact state along an outer face of each side of said angle material toward an outside corner formed by both sides of said angle material to thereby press an end edge of said band auxiliary member against the inside corner of said angle material by tightening the other end of each of said band members in mutually approaching directions on the side of said outside corner, and a support body provided at the extended end of said band auxiliary member to allow said incidental equipment to be attached thereto;

wherein said joining bolt/nut set and said tightening bolt/nut set are arranged only one by one respectively at one end and the other end of each of said band members, instead of a configuration of arranging more than one joining bolt/nut set and more than one tightening bolt/nut set respectively thereat, and wherein an outer face of each of said band members has reinforcing ribs, said reinforcing ribs being provided either only at an upper part or only at a lower part of each of said two band members, and said reinforcing ribs are arranged to ensure that said reinforcing ribs of said two band members are positioned on the sides mutually different in a vertical direction when attachment of said two band members in combination with each other to said angle material is done.

5. The incidental equipment attaching device according to claim 4, wherein each of said band members has a holding part having a length larger than a width of said one side and brought into pressure contact with the outer face of said one side, a joining part joined to the extended end of said band auxiliary member with said joining bolt/nut set, a connecting part for connecting said holding part and said joining part together, and a tightening part provided at an end of said holding part on the side opposite to said connecting part, wherein the other end of each of said band members subjected to tightening in the mutually approaching directions with said tightening bolt/nut set forms said tightening part.

6. The incidental equipment attaching device according to claim 4, wherein in said two band members to be combined with each other, these band members are subjected to bending to ensure that a longitudinal end of either one of the band members covers that of the other.

* * * * *